US008984904B2

(12) United States Patent
Tamura et al.

(10) Patent No.: US 8,984,904 B2
(45) Date of Patent: Mar. 24, 2015

(54) REFRIGERATING DEVICE

(75) Inventors: Kenichi Tamura, Sakai (JP); Yasuhiro Kondou, Sakai (JP)

(73) Assignee: Daikin Industries, Ltd., Osaka-Shi (JP)

( * ) Notice: Subject to any disclaimer, the term of this patent is extended or adjusted under 35 U.S.C. 154(b) by 923 days.

(21) Appl. No.: 13/059,687

(22) PCT Filed: Aug. 18, 2009

(86) PCT No.: PCT/JP2009/064436

§ 371 (c)(1),
(2), (4) Date: Feb. 18, 2011

(87) PCT Pub. No.: WO2010/021321

PCT Pub. Date: Feb. 25, 2010

(65) Prior Publication Data

US 2011/0146314 A1 Jun. 23, 2011

(30) Foreign Application Priority Data

Aug. 22, 2008 (JP) ..... 2008-214132
Aug. 6, 2009 (JP) ..... 2009-183482

(51) Int. Cl.
*F25B 49/02* (2006.01)
*F24F 11/00* (2006.01)
*F25B 13/00* (2006.01)

(52) U.S. Cl.
CPC ..... *F25B 49/022* (2013.01); *F24F 11/008* (2013.01); *F25B 13/00* (2013.01); *F25B 2400/06* (2013.01); *F25B 2600/02* (2013.01)
USPC ..... 62/228.1; 62/510; 62/228.4; 62/228.5; 62/175

(58) Field of Classification Search
CPC ..... F25B 2600/026; F25B 2700/05; F25B 49/022; F25B 2700/21173; F25B 2400/075; F25B 2400/061
USPC ..... 62/160, 175, 228.1, 228.5, 510
See application file for complete search history.

(56) References Cited

U.S. PATENT DOCUMENTS

| | | | | |
|---|---|---|---|---|
| 5,097,670 | A * | 3/1992 | Yoshikawa et al. | 62/99 |
| 6,343,482 | B1 * | 2/2002 | Endo et al. | 62/324.6 |
| 8,555,655 | B2 * | 10/2013 | Benz et al. | 60/800 |
| 2004/0148951 | A1 * | 8/2004 | Loprete | 62/228.1 |
| 2005/0091998 | A1 * | 5/2005 | Cho et al. | 62/175 |
| 2007/0056300 | A1 * | 3/2007 | Crane | 62/175 |
| 2007/0107449 | A1 * | 5/2007 | Crane et al. | 62/175 |
| 2008/0209928 | A1 * | 9/2008 | Hwang et al. | 62/175 |
| 2010/0094434 | A1 * | 4/2010 | Ballet et al. | 700/28 |

FOREIGN PATENT DOCUMENTS

| | | | |
|---|---|---|---|
| EP | 2 019 275 | A1 | 1/2009 |
| EP | 2019275 | A1 * | 1/2009 |

(Continued)

*Primary Examiner* — Frantz Jules
*Assistant Examiner* — Meraj A Shaikh
(74) *Attorney, Agent, or Firm* — Birch, Stewart, Kolasch & Birch, LLP

(57) ABSTRACT

A refrigerating device is provided which can improve COP when a required load is 50% of a maximum load or below. When the load required of a common evaporator is 50% or less, a control unit stops a second compressor and controls the volume of a first compressor. Accordingly, it becomes possible to improve COP when the required load is equal to or below 50% as compared to the case of controlling the first and second compressors simultaneously to a low volume.

3 Claims, 5 Drawing Sheets

(56) References Cited

FOREIGN PATENT DOCUMENTS

| | | | | | |
|---|---|---|---|---|---|
| JP | 61-55556 | A | | 3/1986 | |
| JP | 1-314841 | A | | 12/1989 | |
| JP | 02115585 | A | * | 4/1990 | |
| JP | 3-217761 | A | | 9/1991 | |
| JP | 03217761 | A | * | 9/1991 | |
| JP | 07-111181 | B | * | 11/1995 | ..... F04B 49/06 |
| JP | 7-111181 | B2 | | 11/1995 | |
| JP | 9-178275 | A | | 7/1997 | |
| JP | 09178275 | A | * | 7/1997 | |
| JP | 2007-303796 | A | | 11/2007 | |
| JP | 2007303796 | A | * | 11/2007 | |

* cited by examiner

| | REQUIRED LOAD | 100% | 90% | 80% | 70% | 60% | 50% | 40% | 30% | 20% | 10% |
|---|---|---|---|---|---|---|---|---|---|---|---|
| PRIOR ART | FIRST UNIT LOAD | 100% | 90% | 80% | 70% | 60% | 50% | 40% | 30% | 20% | 10% |
| | SECOND UNIT LOAD | 100% | 90% | 80% | 70% | 60% | 50% | 40% | 30% | 20% | 10% |
| PRESENT INVENTION | FIRST UNIT LOAD | 100% | 90% | 80% | 70% | 60% | 100% | 80% | 60% | 40% | 20% |
| | SECOND UNIT LOAD | 100% | 90% | 80% | 70% | 60% | 0% | 0% | 0% | 0% | 0% |

※RANGE OF LARGE COP IMPROVEMENT EFFECT IN PRESENT INVENTION

REFRIGERATING DEVICE

TECHNICAL FIELD

The present invention relates to a refrigerating device such as an air cooled heat pump chiller.

BACKGROUND ART

There is a conventional refrigerating device composed of a first refrigerating cycle unit including a first compressor, a second refrigerating cycle unit including a second compressor, and a control unit for controlling the volumes of the first and second compressors corresponding to a load required of the first and second refrigerating cycle units (see PTL 1: JP 7-111181 B2).

The control unit controls the volumes of both the first and second compressors to be 50% or less when the required load is 50% of a maximum load or below.

CITATION LIST

Patent Literature

PTL1: JP 7-111181 B2

SUMMARY OF THE INVENTION

Technical Problem

However, in the conventional refrigerating device, because the control unit controls the volumes of both the first and second compressors to be 50% or less when the required load is 50% of a maximum load or below, the first and second compressors are simultaneously operated at a low volume, which causes a problem of lowered COP (i.e., refrigerating capacity/power consumption).

Accordingly, an object of the present invention is to provide a refrigerating device which can improve COP when a required load is 50% of the maximum load or below.

Solution to Problem

As a solution, the present invention provides a refrigerating device comprising:

a first unit including a first compressor, a first heat source-side heat exchanger, a first expansion mechanism, and a common use heat exchanger, these components being connected in a loop in this order via a first refrigerant passage;

a second unit including a second compressor, a second heat source-side heat exchanger, a second expansion mechanism, and the common use heat exchanger, these components being connected in a loop in this order via a second refrigerant passage; and a control unit configured to control a volume of the first compressor and a volume of the second compressor according to a load required of the common use heat exchanger, wherein the control unit is configured to stop the second compressor and to control the volume of the first compressor when the required load is equal to or below a certain value that can be dealt with by the first unit only.

According to the refrigerating device in this invention, the control unit stops the second compressor and controls the volume of the first compressor only when the required load is equal to or below the certain value, so that COP (refrigerating capacity/power consumption) in the case where the required load is equal to or below the certain value can be improved as compared to the case of controlling both the first and the second compressors simultaneously to have low volumes.

In one embodiment, the first unit includes a first four-way selector valve arranged and configured to switch a circulating direction of a refrigerant inside the first refrigerant passage, and the second unit includes a second four-way selector valve arranged and configured to switch a circulating direction of a refrigerant inside the second refrigerant passage.

In the refrigerating device of this embodiment, because the first unit includes the first four-way selector valve and the second unit includes the second four-way selector valve, it is easy to switch between cooling and heating of a substance to be cooled which flows into the common use heat exchanger.

In one embodiment, the first heat source-side heat exchanger is a first condenser, the second heat source-side heat exchanger is a second condenser, and the common use heat exchanger is a common evaporator.

In the refrigerating device of this embodiment, because the first heat source-side heat exchanger is a first condenser, the second heat source-side heat exchanger is a second condenser, and the common use heat exchanger is a common evaporator, the substance to be cooled which flows into the common evaporator is cooled.

In one embodiment, the common evaporator is provided with a cooled substance passage which exchanges heat with the first and second refrigerant passages. The refrigerating device further comprises a temperature sensor arranged and configured to measure temperature of a substance to be cooled in the cooled substance passage outputted from the common evaporator, and when the required load is equal to or below the certain value, the control unit controls the volume of the first compressor in a phased manner while stopping the second compressor in a phased manner, based on a measured value of the temperature sensor.

In the refrigerating device of this embodiment, because the control unit controls the volume of the first compressor in a phased manner while stopping the second compressor in a phased manner based on a measured value of the temperature sensor when the required load is equal to or below the certain value, in the case of increasing the volume of the first compressor, it becomes possible to prevent the temperature of a substance to be cooled in the cooled substance passage from being excessively lowered due to excessive refrigerating capacity and to thereby prevent the cooled substance passage from being frozen up.

In one embodiment, when the required load is larger than the certain value, the control unit controls the volumes of the first and second compressors such that a ratio of the volume of the first compressor to a maximum volume thereof is equal to a ratio of the volume of the second compressor to a maximum volume thereof.

In the refrigerating device of this embodiment, when the required load is larger than the certain value, it is easy to control the volumes of the first and second compressors because these volumes are controlled such that the ratio of the volume of the first compressor to the maximum volume is equal to the ratio of the volume of the second compressor to the maximum volume.

Advantageous Effects of Invention

According to the invention, because the control unit is configured to stop the second compressor and to control the volume of the first compressor when the required load is equal to or below a certain value that can be dealt with by the first unit, COP in the case where the required load is equal to or below the certain value can be improved.

DESCRIPTION OF EMBODIMENTS

Hereinbelow, the invention will be described in detail in conjunction with the embodiments with reference to the drawings.

(First Embodiment)

Figure 1:
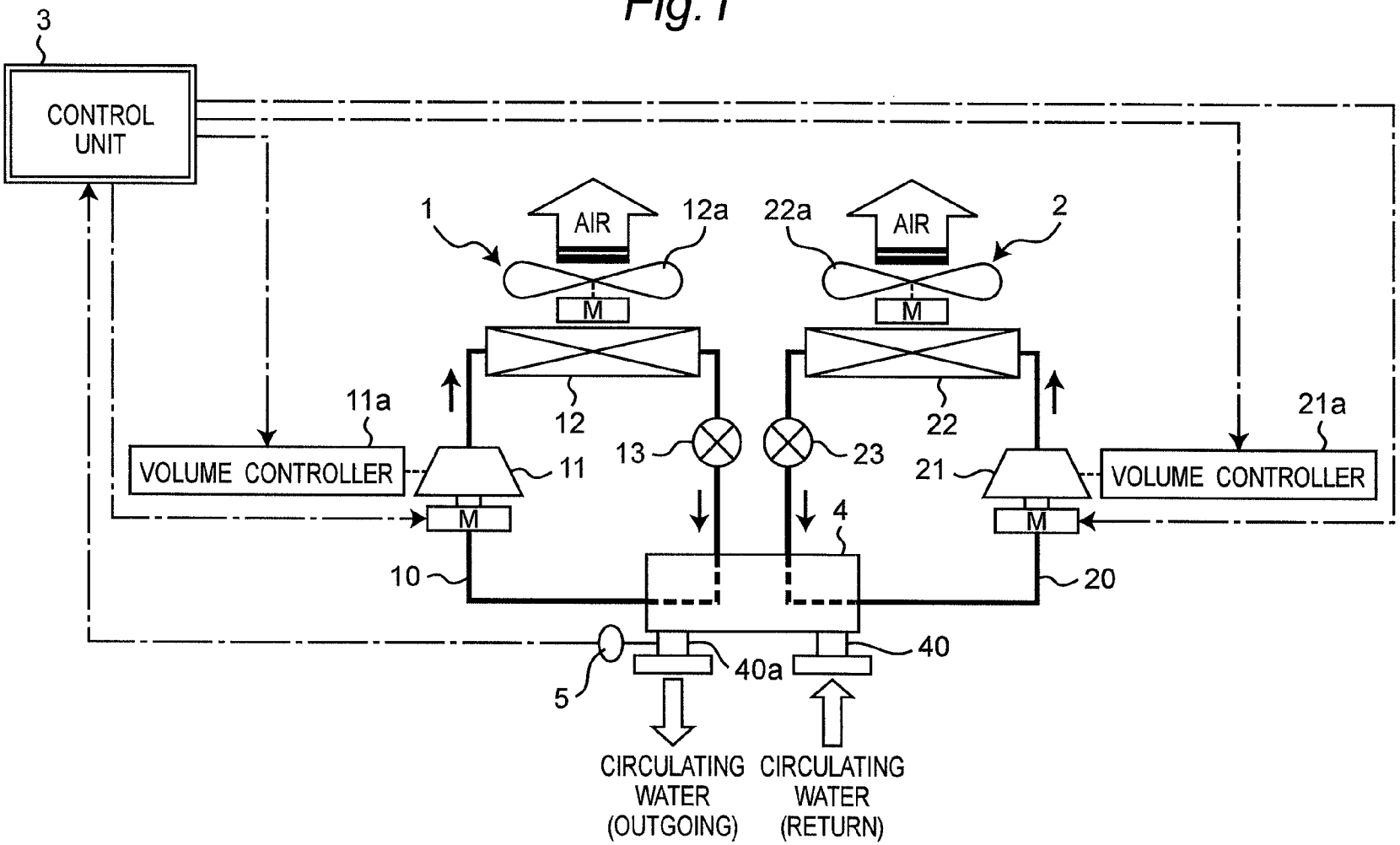
FIG. 1 is a schematic structure view showing a refrigerating device in a first embodiment of the invention.

FIG. 1 is a schematic structure view showing a refrigerating device in a first embodiment of the invention. The refrigerating device has a first unit 1, a second unit 2, and a control unit 3.

The first unit 1 includes a first compressor 11, a first condenser 12 (as a first heat source-side heat exchanger), a first expansion valve 13 (as an expansion mechanism), and a common evaporator 4 (as a common use heat exchanger). The first compressor 11, the first condenser 12, the first expansion valve 13, and the common evaporator 4 are connected in a loop in order via a first refrigerant passage 10 (such as pipes).

The second unit 2 includes a second compressor 21, a second condenser 22 (as a second heat source-side heat exchanger), a second expansion valve 23 (as an expansion mechanism), and a common evaporator 4 (as a common use heat exchanger). The second compressor 21, the second condenser 22, the second expansion valve 23, and the common evaporator 4 are connected in a loop in order via a second refrigerant passage 20 (such as pipes).

The first compressor 11 has a volume controller 11*a* such as a slide valve. The second compressor 21 has a volume controller 21*a* such as a slide valve.

The first condenser 12 is equipped with a fan 12*a* so that heat is exchanged between air delivered by the fan 12*a* and a refrigerant which flows through the first refrigerant passage 10. Similarly, the second condenser 22 is equipped with a fan 22*a* so that heat is exchanged between air delivered by the fan 22*a* and a refrigerant which flows through the second refrigerant passage 20.

The common evaporator 4 is equipped with a cooled substance passage 40 (such as pipes) so that heat is exchanged between water (as a substance to be cooled) which flows through the cooled substance passage 40 and the refrigerants which flow through the first and second refrigerant passages 10, 20. Provided at an outlet 40*a* from the common evaporator 4 of the cooled substance passage 40 is a temperature sensor 5 for measuring the temperature of the water in the cooled substance passage 40 outputted from the common evaporator 4.

Description is now given of the flow of the refrigerant in the first unit 1. As shown with arrows, the refrigerant compressed by the first compressor 11 passes the first condenser 12, the first expansion valve 13, and the common evaporator 4 in this order and returns to the first compressor 11. In this case, air is warmed by the refrigerant in the first condenser 12, while water is cooled by the refrigerant in the common evaporator 4.

Description is now given of the flow of the refrigerant in the second unit 2 in the similar manner. As shown with arrows, the refrigerant compressed by the second compressor 21 passes the second condenser 22, the second expansion valve 23, and the common evaporator 4 in this order, and returns to the second compressor 21. In this case, air is warmed by the refrigerant in the second condenser 22, while water is cooled by the refrigerant in the common evaporator 4.

The control unit 3 controls the volume of the first compressor 11 and the volume of the second compressor 21 according to a load required of the common evaporator 4. The control unit 3 controls the volume controller 11*a* of the first compressor 11 and the volume controller 21*a* of the second compressor 21.

When the required load is below a certain value that is able to be dealt with by the first unit 1 only (i.e., without operating the second unit), the control unit 3 stops the second compressor 21 and controls the volume of the first compressor 11, whereas when the required load is larger than the certain value, the control unit 3 controls both the volume of the first compressor 11 and the volume of the second compressor 21.

In this regard, the refrigerating capacity of the first unit 1 and that of the second unit 2 are identical and the maximum volume of the first compressor 11 and that of the second compressor 21 are identical, which means that the certain value is equal to 50% of the maximum load.

Figure 2:
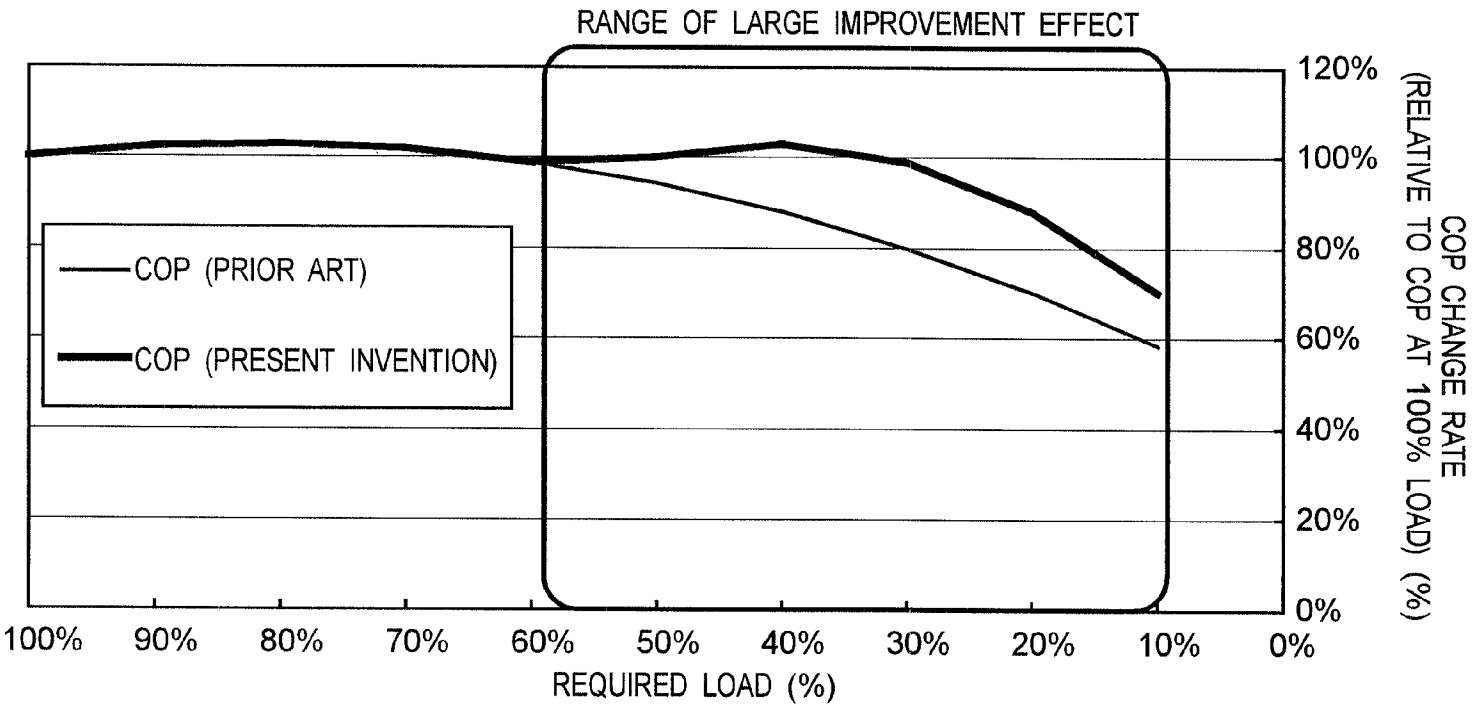
FIG. 2 is an explanatory view showing the comparison between the present invention and the prior art.

Concrete description is now given of volume control by the control unit 3 with reference to FIG. 2. The upper rows of the table in FIG. 2 show conventional volume control, while the lower rows show volume control conducted in this invention.

As shown in the table in FIG. 2, when the required load is in a range of from 100% to 60%, the volumes of the first unit 1 (first compressor 11) and the second unit 2 (second compressor 21) are controlled in this invention as in the prior art. In short, when the required load is larger than 50% of the maximum load, a ratio of the volume of the first compressor 11 to the maximum volume thereof and a ratio of the volume of the second compressor 21 to the maximum volume thereof are equalized.

When the required load is in a range of 50% to 10%, both the volume of the first unit 1 (first compressor 11) and the volume of the second unit 2 (second compressor 21) are controlled in the prior art, whereas in this invention, the volume of the second unit 2 is set to zero (0) (i.e., operation is stopped), and only the volume of the first unit 1 is controlled.

Therefore, in this invention, as shown in the graph in FIG. 2, when the required load is 50% or below, COP (i.e., refrigerating capacity/power consumption) can be improved as compared to the prior art. In short, the performance is improved when the required load is 50% or less.

Description is now given of the shift in volume of the first unit 1 and the second unit 2 when the required load shifts from a value larger than 50% to a value equal to or below 50%. When the required load is equal to or below 50%, the control unit 3 controls the volume of the first compressor 11 in a phased manner while stopping the second compressor 21 in a phased manner based on a measured value of the temperature sensor 5.

Figure 3:
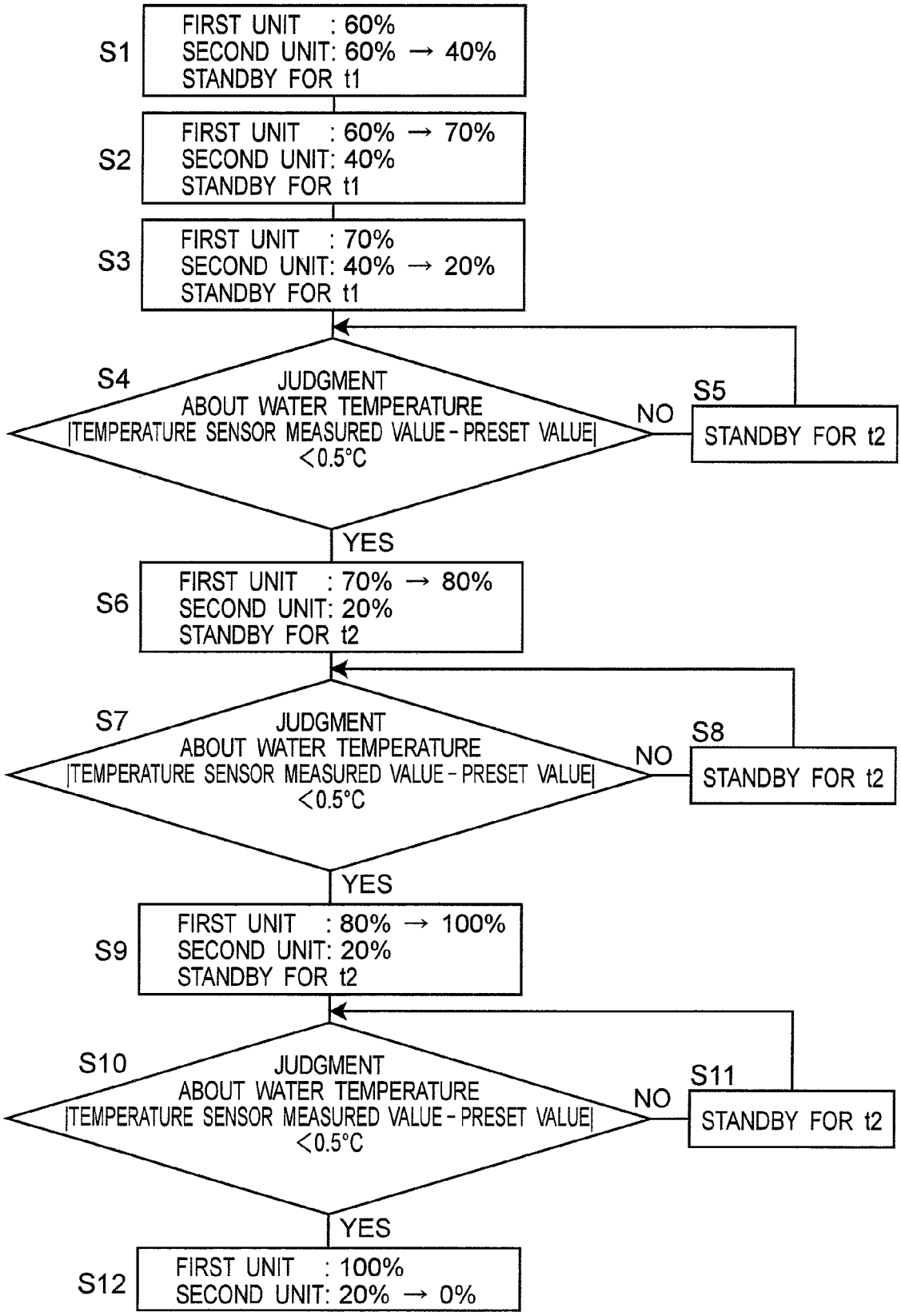
FIG. 3 is a flow chart explaining shift in volume of the first unit and the second unit.

More specifically, when the required load shifts from 60% to 50%, the volume of the first unit 1 is shifted from 60% to 100%, and the volume of the second unit 2 is shifted from 60% to 0%. The shift in volume of the first unit 1 and the second unit 2 in this case will be explained next. As shown in FIG. 3, the volume of the first unit 1 is maintained at 60%, while the volume of the second unit 2 is shifted from 60% to 40%, and the control unit is put in standby mode for a time t1 (Step S1).

Then, the volume of the first unit 1 is shifted from 60% to 70%, while the volume of the second unit 2 is maintained at 40%, and the control unit is put in standby mode for the time t1 (Step S2).

Thereafter, the volume of the first unit 1 is maintained at 70%, while the volume of the second unit 2 is shifted from 40% to 20%, and the control unit is put in standby mode for the time t1 (Step S3).

Then, judgment about water temperature is performed by deciding whether or not an absolute value of a difference between a measured value of the temperature sensor 5 and a preset value is smaller than 0.5° C. (Step S4), and if the absolute value is not smaller than 0.5° C., then the control unit is put in standby mode for a time t2 (Step S5) before the judgment about water temperature is performed again (Step S4).

If the absolute value is smaller than 0.5° C., then the volume of the first unit 1 is shifted from 70% to 80%, while the volume of the second unit 2 is maintained at 20%, and then the control unit is put in standby mode for the time t2 (Step S6).

Then, judgment about water temperature is performed again by deciding whether or not an absolute value of a difference between a measured value of the temperature sensor 5 and the preset value is smaller than 0.5° C. (Step S7), and if the absolute value is not smaller than 0.5° C., then the control unit is put in standby mode for the time t2 (Step S8) before the judgment about water temperature is performed again (Step S7).

If the absolute value is smaller than 0.5° C., then the volume of the first unit 1 is shifted from 80% to 100%, while the volume of the second unit 2 is maintained at 20%, and the control unit is put in standby mode for the time t2 (Step S9).

Then, judgment about water temperature is performed by deciding whether or not an absolute value of a difference between a measured value of the temperature sensor 5 and the preset value is smaller than 0.5° C. (Step S10), and if the absolute value is not smaller than 0.5° C., then the control unit is put in standby mode for the time t2 (Step S11) before the judgment about water temperature is performed again (Step S10).

If the absolute value is smaller than 0.5° C., then the volume of the first unit 1 is maintained at 100%, while the volume of the second unit 2 is shifted from 20% to 0% (Step S12).

As is explained above, when a measured value of the temperature sensor 5 is smaller than the preset value, the volumes of the first compressor 11 and the second compressor 21 are controlled in a phased manner such that the volume of at least one of the first compressor 11 and the second compressor 21 is changed to prevent temperature from becoming out of control. In short, when the capacity of each of the compressors 11, 21 has a large variation width, the temperature may become out of control on a major scale, and if the capacity becomes excessive for example, water temperature in the cooled substance passage 40 may fall and the cooled substance passage 40 may freeze.

According to the above-structured refrigerating device, the control unit 3 stops the second compressor 21 and controls the volume of the first compressor 11 when a required load is equal to or below 50% (certain value), so that COP (refrigerating capacity/power consumption) in the case where the required load is equal to or below 50% can be improved as compared to the case of controlling the first and the second compressors 11, 21 simultaneously to have a low volume.

Moreover, when the required load is equal to or below 50%, the control unit 3 controls the volume of the first compressor 11 in a phased manner while stopping the second compressor 21 in a phased manner based on a measured value of the temperature sensor 5, so that in the case of increasing the volume of the first compressor, it becomes possible to prevent water temperature in the cooled substance passage 40 from being lowered due to excessive refrigerating capacity and to thereby prevent the cooled substance passage 40 from being frozen.

Moreover, when the required load is larger than 50%, a ratio of the volume of the first compressor 11 to the maximum volume thereof and a ratio of the volume of the second compressor 21 to the maximum volume thereof are equalized, so that it is easy to control the volumes of the first and second compressors 11, 21.

(Second Embodiment)

Figure 4A:
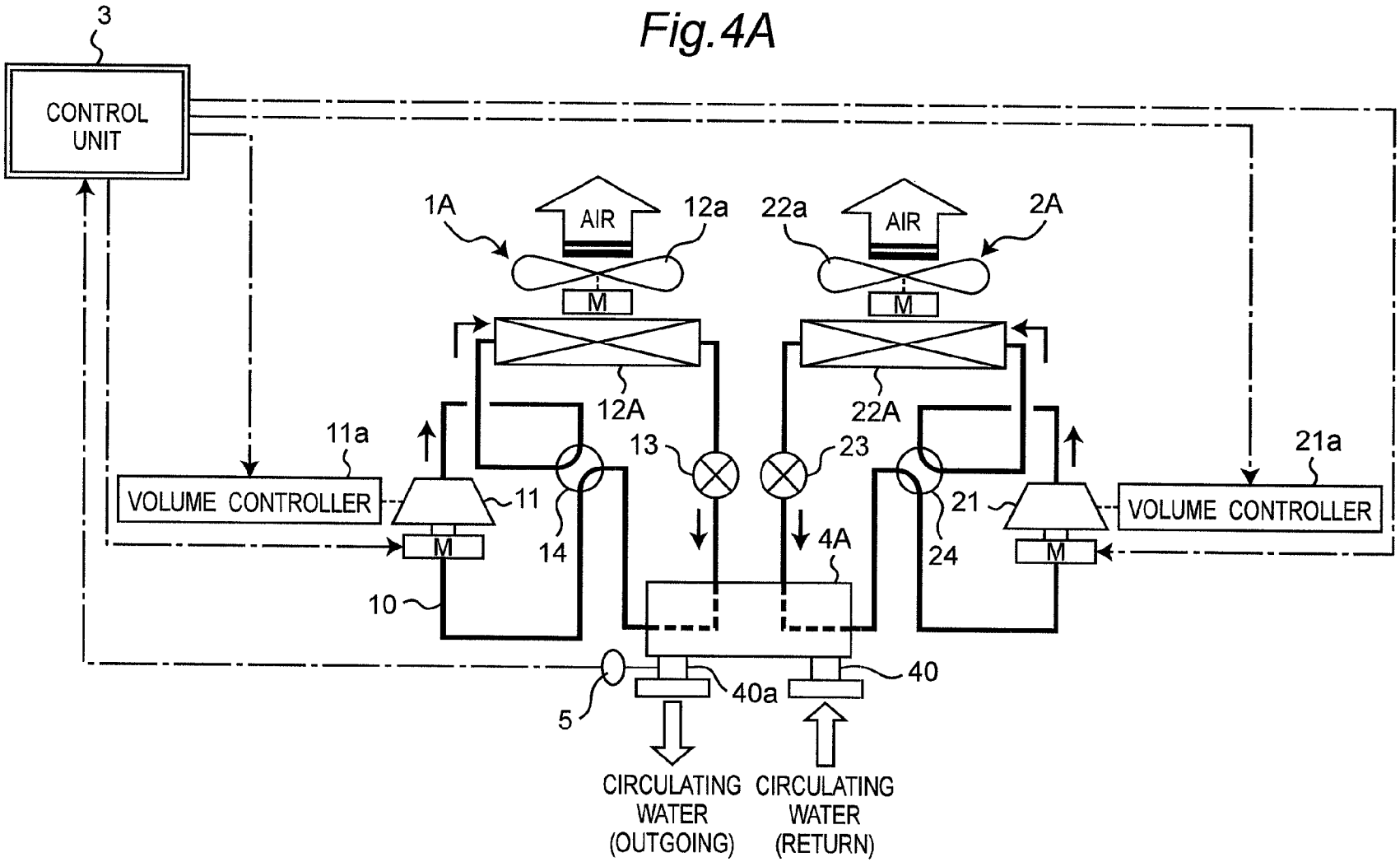
FIG. 4A is a schematic structure view showing a refrigerating device in a second embodiment of the invention in the state of cooling water.
Figure 4B:
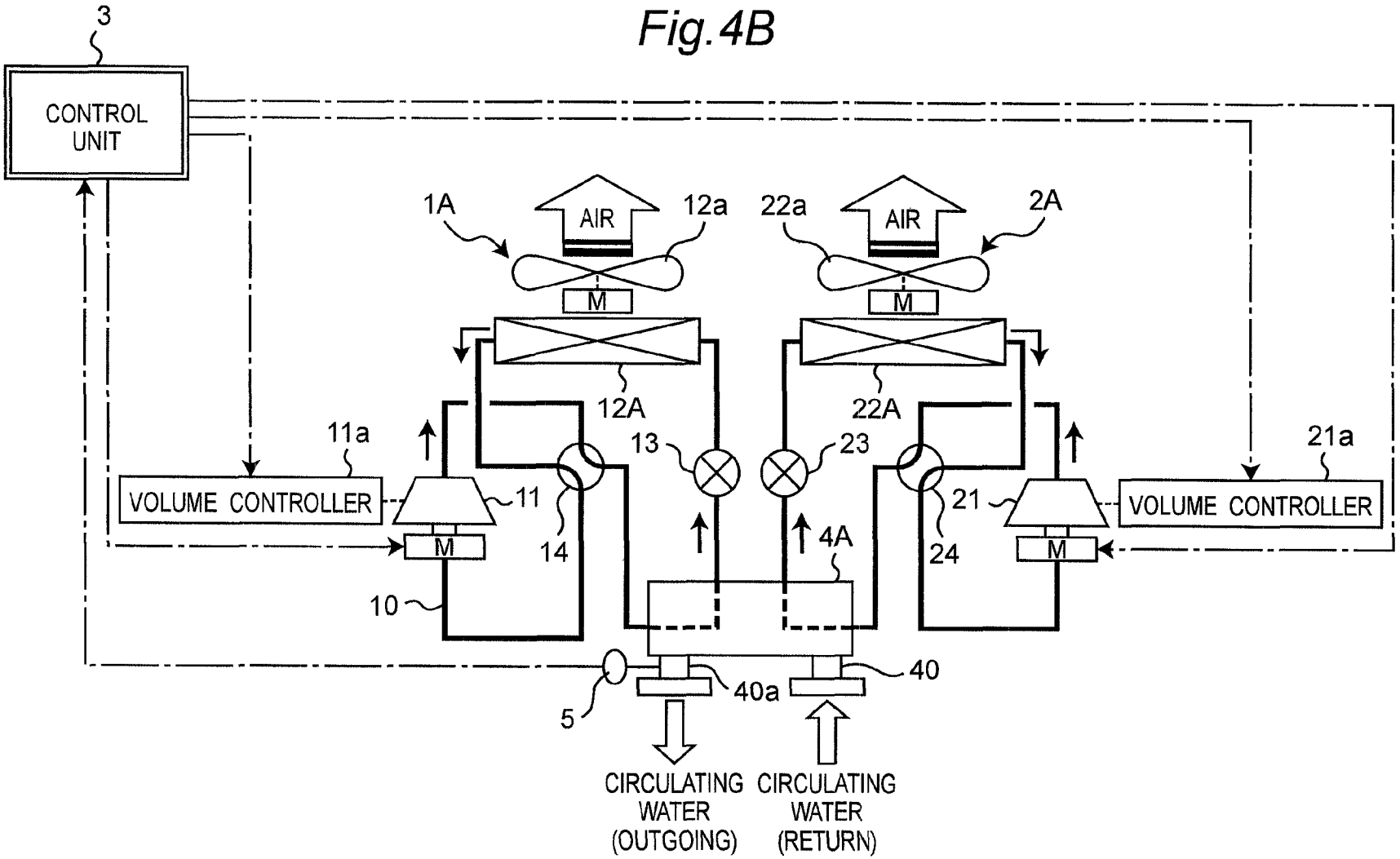
FIG. 4B is a schematic structure view showing the refrigerating device in the second embodiment of the invention in the state of heating water.

FIGS. 4A and 4B show a refrigerating device in a second embodiment of the invention. The second embodiment is different in structure from the first embodiment in that the circulating direction of a refrigerant which flows through the refrigerating device can be switched. It is to be noted that in the second embodiment, component members identical to those in the first embodiment are designated by identical reference signs to omit explanation.

As shown in FIG. 4A, a first unit 1A includes a first compressor 11, a first heat source-side heat exchanger 12A, a first expansion mechanism 13, and a common use heat exchanger 4A, which are connected in a loop in this order via a first refrigerant passage 10.

A second unit 2A includes a second compressor 21, a second heat source-side heat exchanger 22A, a second expansion mechanism 23, and a common use heat exchanger 4A, which are connected in a loop in this order via a second refrigerant passage 20.

The first unit 1A includes a first four-way selector valve 14 for switching a circulating direction of a refrigerant inside the first refrigerant passage 10. The first four-way selector valve 14 is provided so as to cross a refrigerant passage between the first compressor 11 and the first heat source-side heat exchanger 12A and a refrigerant passage between the first compressor 11 and the common use heat exchanger 4A.

The second unit 2A includes a second four-way selector valve 24 for switching a circulating direction of a refrigerant inside the second refrigerant passage 20. The second four-way selector valve 24 is provided so as to cross a refrigerant passage between the second compressor 21 and the second heat source-side heat exchanger 22A and a refrigerant passage between the second compressor 21 and the common use heat exchanger 4A.

Description is now given of the flow of a refrigerant in the refrigerating device.

First, as shown in FIG. 4A, the refrigerant of the first unit LA is made to flow through the first compressor 11, the first heat source-side heat exchanger 12A, the first expansion mechanism 13, and the common use heat exchanger 4A in this order as shown with arrows by switching of the first four-way selector valve 14. In this case, the first heat source-side heat exchanger 12A functions as a condenser to warm air with the refrigerant, while the common use heat exchanger 4A functions as an evaporator to cool water with the refrigerant.

Similarly, the refrigerant of the second unit 2A is made to flow through the second compressor 21, the second heat source-side heat exchanger 22A, the second expansion mechanism 23, and the common use heat exchanger 4A in this order as shown with arrows by the switching of the second four-way selector valve 24. In this case, the second heat source-side heat exchanger 22A functions as a condenser to warm air with the refrigerant, while the common use heat exchanger 4A functions as an evaporator to cool water with the refrigerant.

Also, as shown in FIG. 4B, the refrigerant of the first unit 1A is made to flow through the first compressor 11, the common use heat exchanger 4A, the first expansion mechanism 13, and the first heat source-side heat exchanger 12A in this order as shown with arrows by switching of the first four-way selector valve 14. In this case, the first heat source-side heat exchanger 12A functions as an evaporator to cool air with the refrigerant, while the common use heat exchanger 4A functions as a condenser to warm water with the refrigerant.

Similarly, the refrigerant of the second unit 2A is made to flow through the second compressor 21, the common use heat exchanger 4A, the second expansion mechanism 23 and the second heat source-side heat exchanger 22A in order as shown with arrows by the switching of the second four-way selector valve 24. In this case, the second heat source-side heat exchanger 22A functions as an evaporator to cool air with the refrigerant, while the common use heat exchanger 4A functions as a condenser to warm water with the refrigerant.

The control unit 3 controls the volume of the first compressor 11 and the volume of the second compressor 21 according to a load required of the common use heat exchanger 4A. When the required load is equal to or below a certain value (50% or less in this embodiment) that can be dealt with by the first unit 1A only, the control unit 3 stops the second compressor 21 and controls the volume of the first compressor 11.

When the required load is equal to or below the certain value, the control unit 3 controls the volume of the first compressor 11 in a phased manner while stopping the second compressor 21 in a phased manner based on a measured value of the temperature sensor 5 provided in the cooled substance passage 40 on the outlet side of the common use heat exchanger 4A.

When the required load is larger than the certain value, the control unit 3 controls the volumes of the first and second compressors such that a ratio of the volume of the first compressor 11 to the maximum volume thereof is equal to a ratio of the volume of the second compressor 21 to the maximum volume thereof.

Since concrete volume control by the control unit 3 is similar to that in the first embodiment (FIG. 2 and FIG. 3), explanation thereof will be omitted.

According to the above-structured refrigerating device, the control unit 3 stops the second compressor 21 and controls the volume of the first compressor 11 when a required load is equal to or below the certain value, so that COP (refrigerating capacity/power consumption) in the case where the required load is equal to or below the certain value can be improved as compared to the case of controlling the first and the second compressors 11, 21 simultaneously to a low volume.

Moreover, the first unit 1A includes the first four-way selector valve 14, and the second unit 2A includes the second four-way selector valve 24, so that cooling or heating of an substance to be cooled, which flows into the common use heat exchanger 4A, can be switched easily.

Moreover, when the required load is equal to or below the certain value, the control unit 3 controls the volume of the first compressor 11 in a phased manner while stopping the second compressor 21 in a phased manner based on a measured value of the temperature sensor 5, so that in the case of increasing the volume of the first compressor 11, it is possible to prevent water temperature in the cooled substance passage 40 from being lowered (or increased) too much due to excessive refrigerating capacity and to thereby prevent the cooled substance passage 40 from being frozen (or heated).

Moreover, when the required load is larger than the certain value, the control unit 3 equalizes a ratio of the volume of the first compressor 11 to the maximum volume thereof and a ratio of the volume of the second compressor 21 to the maximum volume thereof, so that it is easy to control the volumes of the first and second compressors 11, 21.

The present invention shall not be limited to the embodiments disclosed. For example, the expansion valve as an expansion mechanism may be replaced by other components such as capillary tubes. Brine may be used as a substance to be cooled. The refrigerating capacities of the first unit 1 and the second unit 2 may not be identical, and the maximum volumes of the first compressor 11 and the second compressor 21 may not be identical either.

In the first embodiment, the first condenser 12 and the second condenser 22 may be replaced by evaporators, while the common evaporator 4 may be replaced by a common condenser, and the substance to be cooled may be warmed by the common condenser.

REFERENCE SIGNS

1, 1A first unit
11 first compressor
11*a* volume controller
12 first condenser (first heat source-side heat exchanger)
12A first heat source-side heat exchanger
12*a* fan
13 first expansion valve (first expansion mechanism)
14 first four-way selector valve
10 first refrigerant passage
2, 2A second unit
21 second compressor
21*a* volume controller
22 second condenser (second heat source-side heat exchanger)
22A second heat source-side heat exchanger
22*a* fan
23 second expansion valve (second expansion mechanism)
24 second four-way selector valve
20 second refrigerant passage
3 control unit
4 common evaporator (common use heat exchanger)
4A common use heat exchanger
40 cooled substance passage
40*a* outlet
5 temperature sensor

The invention claimed is:

1. A refrigerating device comprising:

a first unit including the following components connected together in a loop and in the following order via a first refrigerant passage: a first compressor, a first heat source-side heat exchanger, a first expansion mechanism, and a common use heat exchanger;

a second unit including the following components connected together in a loop and in the following order via a second refrigerant passage: a second compressor, a second heat source-side heat exchanger, a second expansion mechanism, and the common use heat exchanger; and a control unit configured to control a volume of the first compressor and a volume of the second compressor according to a load required of the common use heat exchanger;

the control unit being configured to stop the second compressor and to control the volume of the first compressor when the required load is equal to or below a certain value that can be accommodated by the first unit only;

the first heat source-side heat exchanger being a first condenser;

the second heat source-side heat exchanger being a second condenser;

the common use heat exchanger being a common evaporator;

the common evaporator being provided with a cooled substance passage which exchanges heat with the first and second refrigerant passages; and a temperature sensor arranged and configured to measure temperature of a substance to be cooled in the cooled substance passage outputted from the common evaporator, wherein when the required load is equal to or below the certain value, the control unit initiates a multi-phase sequence to stop the second compressor and make the volume of the first compressor reach a desired increased value, which accommodates the required load, the multi-phase sequence controlling the volumes of the first and second compressors in a phased manner over a series of phases by:

increasing the volume of the first compressor by a certain amount during at least two of said phases, decreasing the volume of the second compressor by a certain amount during at least two of said phases, and checking whether an absolute value of a difference between a measured value of the temperature sensor and a preset value becomes smaller than a given value before transitioning between phases, said preset value being set in order to control variations in the measured value of the temperature during the series of phases, and when the checking indicates that the absolute value is not smaller than the given value, performing the checking after a predetermined time has elapsed.

2. The refrigerating device as claimed in claim 1, wherein the first unit includes a first four-way selector valve arranged and configured to switch a circulating direction of a refrigerant inside the first refrigerant passage, and the second unit includes a second four-way selector valve arranged and configured to switch a circulating direction of a refrigerant inside the second refrigerant passage.

3. The refrigerating device as claimed in claim 1, wherein when the required load is larger than the certain value, the control unit controls the volumes of the first and second compressors such that a ratio of the volume of the first compressor to a maximum volume thereof is equal to a ratio of the volume of the second compressor to a maximum volume thereof.

* * * * *